US005960095A

United States Patent [19]

Chang

[11] Patent Number: 5,960,095

[45] Date of Patent: Sep. 28, 1999

[54] LOUDSPEAKER ASSEMBLY WITH ADJUSTABLE DIRECTIVITY

[75] Inventor: George Chang, Kaohsiung, Taiwan

[73] Assignee: Sun Technique Electric Co., Ltd., Kaohsiung, Taiwan

[21] Appl. No.: 09/095,715

[22] Filed: Jun. 11, 1998

[51] Int. Cl.[6] ..... H04R 25/00

[52] U.S. Cl. ..... 381/387; 381/386; 181/150

[58] Field of Search ..... 381/387, 87, 86, 381/186, 396, 386, 395, FOR 151, FOR 165; 181/150, 153, 154, 199

[56] References Cited

U.S. PATENT DOCUMENTS 4,811,406 3/1989 Kawachi ..... 381/186
5,133,428 7/1992 Perrson ..... 181/153
5,148,490 9/1992 Draffen ..... 381/86
5,319,164 6/1994 Shen ..... 181/150

*Primary Examiner*—Huyen Le

[57] ABSTRACT

A loudspeaker assembly includes a base, a supporting plate, a casing, and a loudspeaker. The supporting plate is securely mounted to the base and includes a jointing member formed on a side thereof. The casing has a first end securely engaged with the supporting plate and a second end. The loudspeaker has a first end extending beyond a second end of the casing and a second end with a planar bottom side in a universal joint connection with the jointing member on the supporting plate. The loudspeaker has a section, which is slidable relative to an inner periphery of the casing to allow adjustment of an orientation of the loudspeaker relative to the supporting plate.

1 Claim, 3 Drawing Sheets

LOUDSPEAKER ASSEMBLY WITH ADJUSTABLE DIRECTIVITY

BACKGROUND OF THE INVENTION

1. Field of the Invention

The present invention relates to a loudspeaker assembly in which the directivity thereof is adjustable.

2. Description of the Related Art

In order to obtain a stereo environment for listening music and to seek clear bass and treble, each loudspeaker should have the best directivity in which positioning of the loudspeakers is the most important thing for acquiring the best directivity. The loudspeakers of a conventional loudspeaker structure, regardless of frequency, are secured on the same side of a sound box. In practice, when adjustment of directivity is required (e.g., due to limitation of the environment or contour), the sound position of the loudspeaker must be changed. Such a change reflects less affection on bass loudspeakers, which have a low requirement in the directivity, yet other kinds of loudspeakers (e.g., treble loudspeakers), are adversely affected. As a result, distortion is generated, and clarity of the residual sound is poor. The present invention is intended to provide a loudspeaker assembly with adjustable directivity to solve this problem.

SUMMARY OF THE INVENTION

A loudspeaker assembly in accordance with the present invention includes a base, a supporting plate, a casing, and a loudspeaker. The supporting plate is securely mounted to the base and includes a jointing member formed on a side thereof. The casing has a first end securely engaged with the supporting plate and a second end. The loudspeaker has a first end extending beyond a second end of the casing and a second end with a planar bottom side in a universal joint connection with the jointing member on the supporting plate. The loudspeaker has a section, which is slidable relative to an inner periphery of the casing to allow adjustment of an orientation of the loudspeaker relative to the supporting plate. Thus, the directivity of the loudspeaker can be adjusted.

In an embodiment of the invention, the jointing member may be a protrusion with a spherical surface. In another embodiment of the invention, the jointing member includes a stub formed on the side of the supporting plate and a ball partially, rotatably received in the stub. Preferably, a spring is mounted around the stub and includes an end, which contacts with the planar bottom side of the loudspeaker. In a further embodiment of the invention, the jointing member includes a protrusion formed on the side of the supporting plate, and a spring is mounted around the protrusion and includes an end contacting with the planar bottom side of the loudspeaker.

Other objects, advantages, and novel features of the invention will become more apparent from the following detailed description when taken in conjunction with the accompanying drawings.

DETAILED DESCRIPTION OF THE PREFERRED EMBODIMENTS

Figure 1:
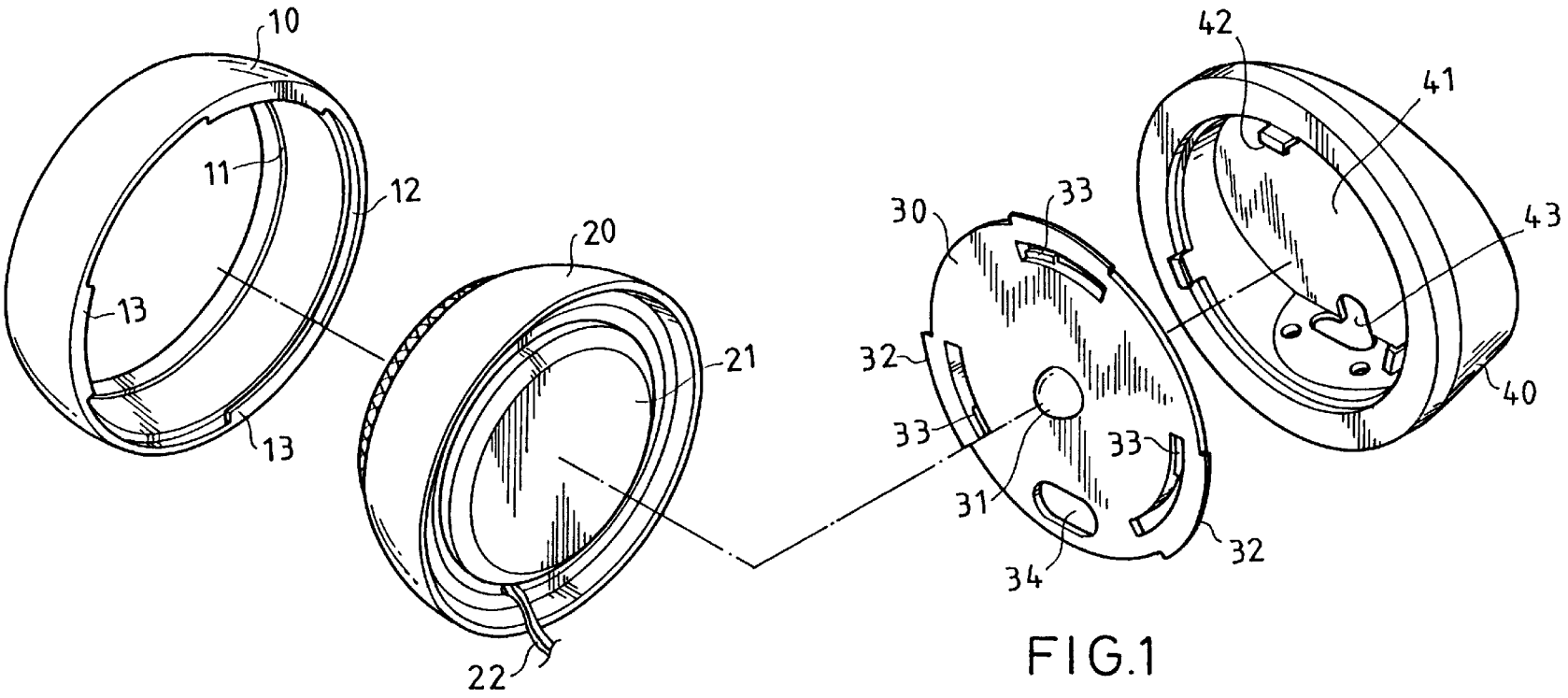
FIG. 1 is an exploded perspective view of a loudspeaker assembly in accordance with the present invention.
Figure 2:
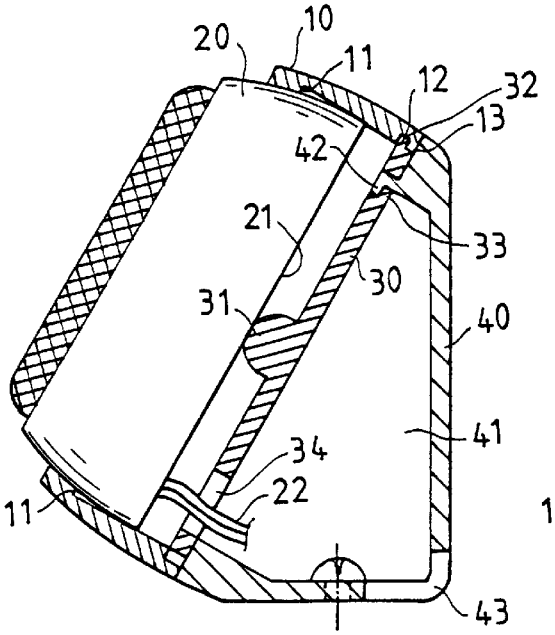
FIG. 2 is a sectional view of the loudspeaker assembly.

Referring to the drawings and initially to FIGS. 1 and 2, a loudspeaker assembly in accordance with the present invention generally includes a casing 10, a loudspeaker 20, a supporting plate 30, and a base 40. The casing 10 is conical and includes a shoulder 11 defined in an inner side of a relatively smaller end thereof and recessed sections 12 defined in an inner side of a relatively larger end thereof. Engaging edges 13 are formed on two ends of each recessed section 12 for engaging with the supporting plate 30.

The loudspeaker 20 includes a front section extending beyond the relatively smaller end of the casing 10 and a rear section which is slidable relative to an inner periphery of the casing 10. The loudspeaker 20 includes a planar bottom side 21.

The supporting plate 30 includes a number of lips 32 on a periphery thereof so as to engage with the recessed sections 12 on the casing 10 and is thus retained in position by the engaging edges 13. The supporting plate 30 further includes a number of engaging members 33 for engaging with hooked members 42 formed on a bottom of the base 40. The supporting plate 30 further includes a protrusion 31 formed on a side thereof which faces the planar bottom side 21 of the loudspeaker 20. The supporting plate 30 further includes an opening 34 through which leads 22 from the loudspeaker are extended. The base 40 includes a compartment 41 for mounting the supporting plate 30. The base 40 further includes a hole 43 through which the leads 22 from the loudspeaker 20 are extended.

Figure 3:
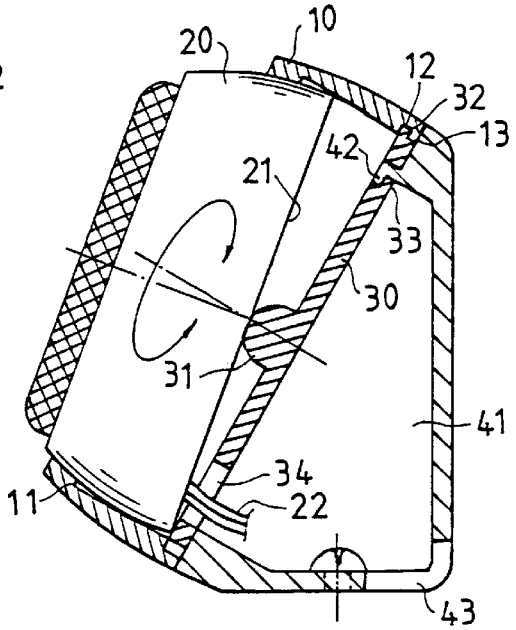
FIG. 3 is a sectional view similar to FIG. 2, illustrating adjustment of directivity of the loudspeaker.

As shown in FIG. 2, the planar bottom side 21 of the loudspeaker 20 is in a universal joint connection with the protrusion 31 which has a spherical surface. By such an arrangement, the user may rotate the loudspeaker 20 to a desired position and thus adjust the directivity of the loudspeaker 20, best shown in FIG. 3.

Figure 4:
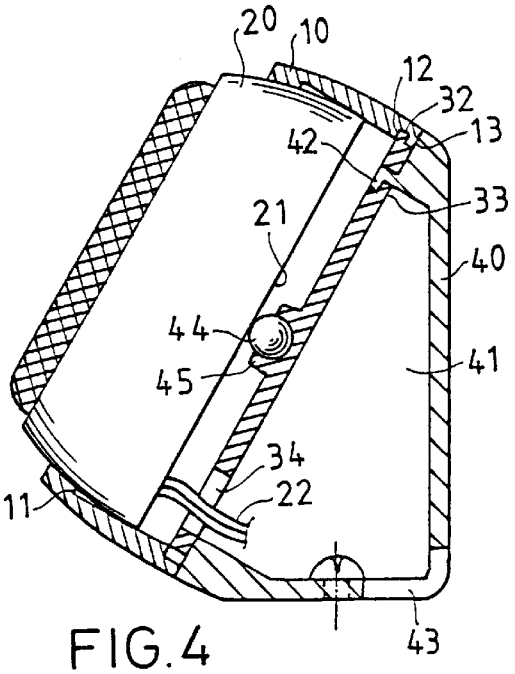
FIGS. 4–6 are sectional views illustrating modified embodiments of the loudspeaker assembly in accordance with the present invention.
Figure 5:
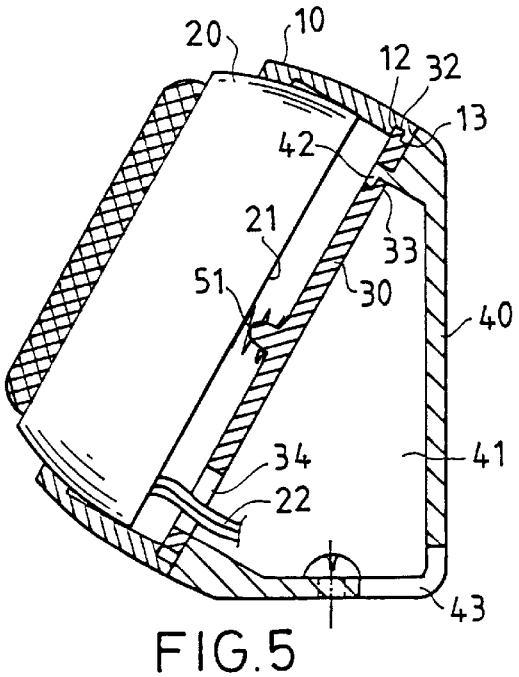
Figure 6:
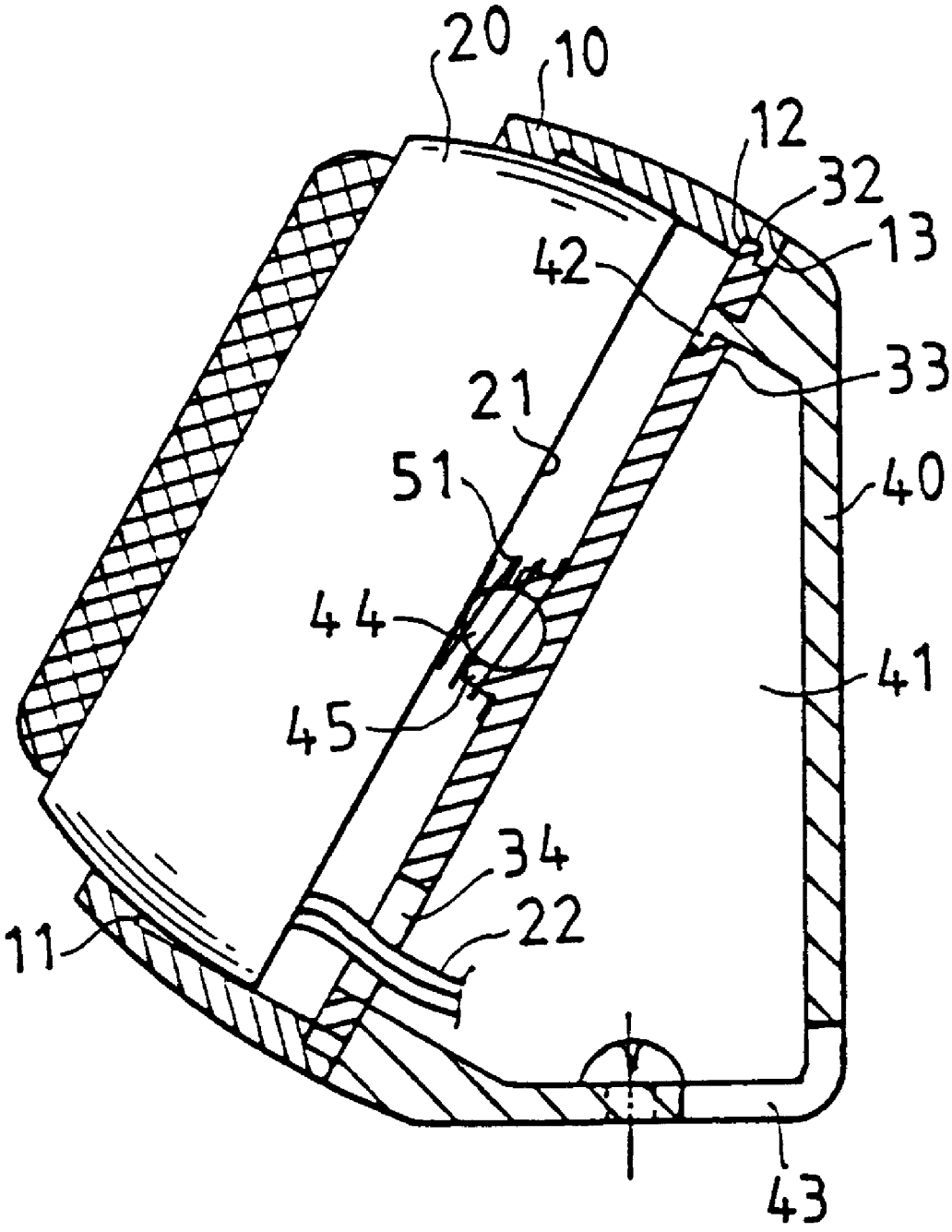

FIG. 4 illustrates a modified embodiment of the universal joint connection, wherein the protrusion 31 on the supporting plate 30 is replaced by a ball 44 which is partially, rotatably received in a stub 45 formed on the supporting plate 30. FIG. 5 illustrates another modified embodiment of the universal joint connection, wherein the protrusion on the supporting plate 30 is not spherical and includes a spring 51 mounted therearound, and wherein an end of the spring 51 contacts with the planar bottom side 21 of the loudspeaker 20 to provide the required universal joint connection. FIG. 6 illustrates an embodiment modified from the embodiment shown in FIG. 4, wherein a spring 51 is mounted around the stub 45 and includes an end contacting with the planar bottom side 21 of the loudspeaker 20 to allow universal joint connection therebetween.

According to the above description, it is appreciated that the directivity of the loudspeaker 20 of the present invention is adjustable as the position (i.e., orientation) thereof is adjustable relative to the fixed supporting plate 30.

Although the invention has been explained in relation to its preferred embodiment, it is to be understood that many other possible modifications and variations can be made without departing from the spirit and scope of the invention as hereinafter claimed.

What is claimed is:

1. A loudspeaker assembly, comprising:

a base, a supporting plate securely mounted to the base and including a jointing member formed on a side thereof, a casing having a first end securely engaged with the supporting plate and a second end, the casing further including an inner periphery, and a loudspeaker having a first end extending beyond the second end of the casing and a second end with a planar bottom side in a universal joint connection with the jointing member on the sup porting plate, the loudspeaker having a section which is slidable relative to the inner periphery of the casing to allow adjustment of an orientation of the loudspeaker relative to the supporting plate;

wherein the jointing member includes a protrusion formed on the side of the supporting plate and a spring mounted around the protrusion, and the spring includes an end contacting with the planar bottom side of the loudspeaker.

* * * * *